US005515658A

United States Patent [19]

Jorde

[11] Patent Number: 5,515,658

[45] Date of Patent: May 14, 1996

[54] JAMB STUD

[76] Inventor: Edward P. Jorde, Cottage Pl.; P.O. Box 103, Granite Springs, N.Y. 10527

[21] Appl. No.: 72,097

[22] Filed: Jun. 7, 1993

[51] Int. Cl.[6] ..... E04B 1/04

[52] U.S. Cl. ..... 52/215; 52/731.9; 52/456; 49/504

[58] Field of Search ..... 52/731.8, 731.9, 52/210, 213, 215, 456, 457, 458; 49/504

[56] References Cited

U.S. PATENT DOCUMENTS

| | | | |
|---|---|---|---|
| 1,544,760 | 7/1925 | Kiefer . | |
| 1,838,129 | 12/1931 | Baum | 49/504 |
| 1,926,673 | 9/1933 | Gregg . | |
| 2,291,388 | 7/1942 | Knudsen | 52/213 |
| 2,998,108 | 8/1961 | Stoner et al. | 52/731.9 |
| 3,299,592 | 1/1967 | Cable . | |
| 4,058,951 | 11/1977 | Dean | 49/504 |
| 4,177,968 | 12/1979 | Chapman | 52/731.8 |
| 4,424,653 | 1/1984 | Heinen | 52/213 |

*Primary Examiner*—Kien T. Nguyen
*Attorney, Agent, or Firm*—Joseph B. Taphorn

[57] ABSTRACT

A new interior wall construction relies on a new metal stud. The new stud is a U-shaped channel having parallel sides and a generally flat bight. The bight is recessed interiorly of its edges and mounts a wood block. The block is secured by diagonally inserted screws piercing the interior corners of the recess. A sheet rock installer mounts the plaster board so as to have common edges with the stud. Thereafter a carpenter inserts a wood blocking in the stud prior to mounting the door jamb.

13 Claims, 1 Drawing Sheet

JAMB STUD

INTRODUCTION

1.Field of the Invention

This invention relates to door jams, and more particularly to a new metal stud for mounting door jambs in drywall construction.

2. Background of the Invention

In present day dry wall (sheet rock/plaster board) construction, a unionized carpenter must be called to a construction site twice, once before the dry wall installers put up the sheet rock, and once afterwards. A unionized carpenter on his initial visit to the construction site, installs wood blocking on the door stud. On his second visit, he completes the door installation.

3. Prior Art

Prior art patents include U.S. Pat. No. 1,544,760 issued Jul. 7, 1925 to Kiefer; he shows a door buck of channel formation having inturned free ends and anchor plates having enlarged heads fitting behind the free ends and laid between adjacent courses of concrete block or the like, to minimize displacement and subsequent cracking of plaster; wood filler blocks in the door buck serve for mounting door jambs. U.S. Pat. No. 1,838,129 issued Dec. 29, 1931 to Baum shows an open metal channel having a wood block and anchors for plaster to be first installed, and then a tile wall (masonary wall) laid; thereafter plaster is applied to the wall and channel, and a door jamb in two portions screwed to the wood block as well as a door stop. U.S. Pat. No. 1,926,673 issued Sep. 12, 1933 to Gregg shows the use of a plurality of adjustable U-shaped anchor members for compensating for vertical inexactness of rough bucks, and securing trim and door jambs thereto. U.S. Pat. No. 3,299,592 issued Jan. 24, 1967 to Cable shows a channeled metal door jamb secured to a metal stud as by spot welding and/or screws, and wallboard secured to both by driving self-threading screws.

SUMMARY OF THE INVENTION

Accordingly it is an object of the invention to enable less costly inside wall constructions.

Another object of the invention is enable faster inside wall constructions.

Still another object of the invention is enable such wall constructions using simple materials which are easy to handle.

The objects of the invention are accomplished through the provision of a new type of metal stud that a sheet rock installer can mount and secure plaster board to before a carpenter need be called to mount the door. The new type of metal stud is a generally U-shaped member that has an inwardly extending wide recess or countersink on the outer face of its bight. The studs are mounted in prelocated stud anchors on the floor and ceiling. The legs of the U-shaped member extend parallel to each other and are such that the plasterboards may be directly secured to them as by screws, the recessed mounting of the wood blocking removing the need for the plasterboard to extend beyond the end of the stud.

Only after putting up the plaster board need the carpenter be called. The carpenter then mounts a wood blocking in the recess in the bight of the U-shaped member, securing the blocking to the U-shaped member as by diagonal screws engaging it at the outer inner edges of the inward recess. The carpenter then mounts a conventional door jamb which is secured to the end of the wall by passing screws through the jamb to engage the wood blocking. Vertical spacers behind the jamb are so located as to overlap the sheet rock and the outer edges of the bight of the u-shaped member when the jamb is mounted and to provide a firm backup and mounting for the jamb when the screws are seated in the wood blocking, while at the same time providing a finished appearance.

BRIEF DESCRIPTION OF THE DRAWINGS OF AN EMBODIMENT OF THE INVENTION

These and other objects, features, and advantages of the invention will become apparent from a reading of the following description of a preferred embodiment of the invention, when considered with the accompanying drawings wherein:

FIG. 1 is a view of a horizontal cross-section of a wall construction according to the present state of the art; and FIG. 2 is a view of a horizontal cross-section of a wall construction according to the new invention.

DETAILED DESCRIPTION OF A PREFERRED EMBODIMENT OF THE INVENTION

Figure 1:
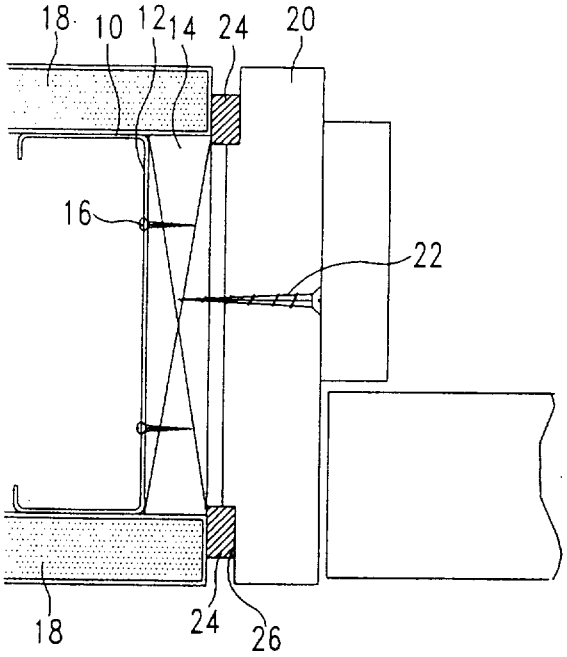
PRIOR ART FIG. 1

Referring now more particularly to FIG. 1 of the drawing, existing wall construction is shown as involving a U-shaped metal stud 10 which would be mounted upon appropriate anchors on the floor and ceiling about a door or archway. To the bight 12 of the U-shaped stud 10 would be mounted by a unionized carpenter a wood blocking 14 as by screws 16 from the inside of the stud. Thereafter the sheet rock installer would mount the plaster board 18, the plaster board being mounted so that it overlapped the wood blocking including for appearances sake.

After the sheet rock installer was finished, the unionized carpenter would be called back to mount the door jamb 20 (and stop) as by screws 22 extending through the jamb in to the wood blocking. Spacer blocks 24 seated in offsets 26 on the insides of the and the wood blocking 14, complete the appearance.

Figure 2:
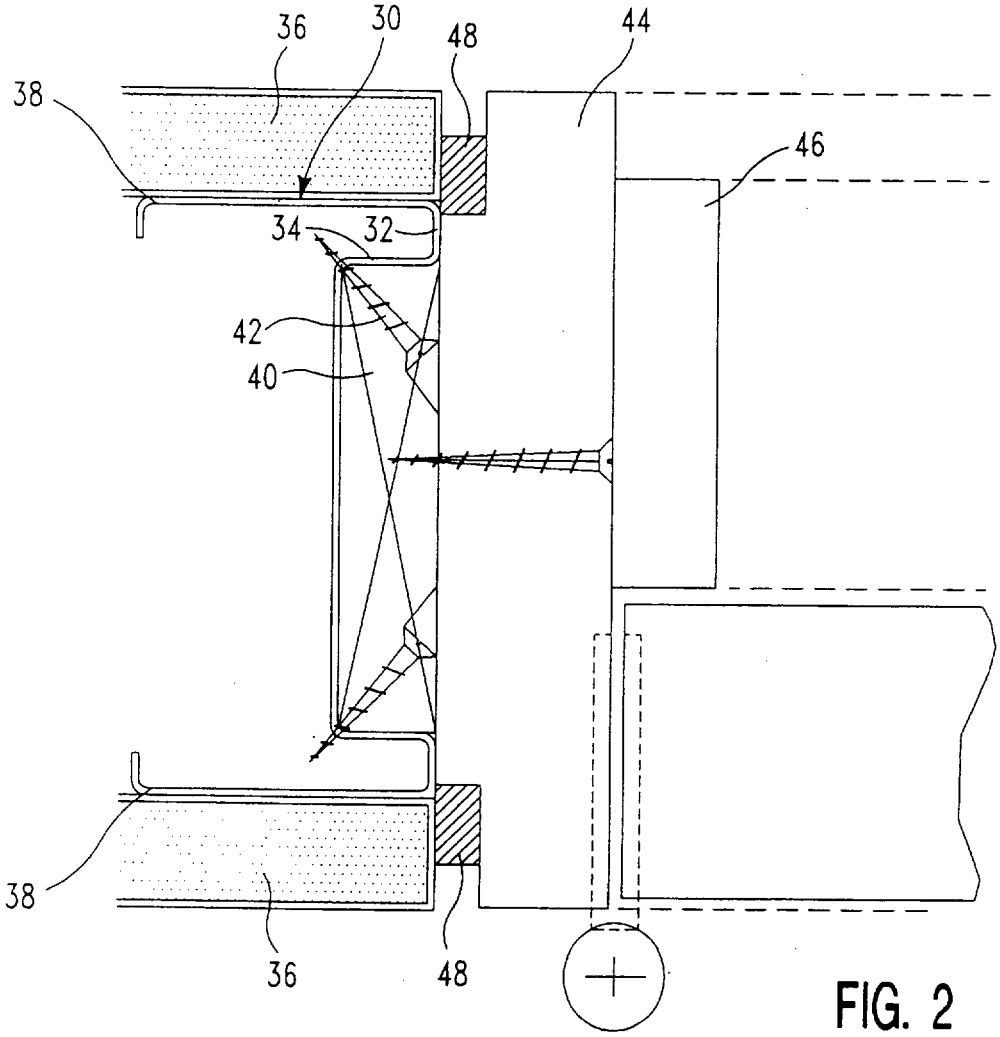

FIG. 2 shows a wall construction according to the invention. Here a U-shaped metal stud generally indicated by the numeral 30 has a generally flat bight 32 formed with an inwardly extending wide recess or countersink 34 on its outer surface. This stud too is mounted upon appropriate anchors on the floor and ceiling about a door or archway. However, now the sheet rock installers would proceed directly to mount the plaster board 36 on the parallel side legs 38 of the stud as by screws, making sure that the edge of the plaster board reached the bight edge of the stud.

After the sheet rock installers are finished, the carpenter is called for the first time to install the door. To this end, he would mount from the outside the wood blocking 40 into the stud bight recess 34 by inserting screws 42 diagonally therethrough so they pierce the stud at its recess inner corners. Next he would mount the door jamb 44 and stop 46 in conventional fashion, only now the spacing blocks 48 overlap the joint between the plaster board 36 and the metal stud 30.

It will be evident that applicant has provided a new metal stud and a new wall construction and method of achieving same that is less expensive and simple and easy to use.

It will be appreciated by those skilled in the art that other and different applications may be made of the principals of the invention. Accordingly, it is desired to be limited only by the scope or spirit of the appended claims.

What is claimed is:

1. A wall construction embodying plaster board and a metal stud having parallel legs and a bight having an outer surface interconnecting the legs, and a shallow recess in the outer surface of the bight spaced from the legs, the free ends of the legs extending beyond the bottom of the recess to provide areas where the plaster board is attached externally to the legs with penetrating long fasteners clear of the recess.

2. A wall construction according to claim 1, wherein the recess is generally rectangular in cross-section.

3. A wall construction according to claim 2, and a wood blocking mounted in said recess.

4. A wall construction according to claim 3, wherein the recess is generally rectangular in cross-section and has inner corners and the wood blocking is secured in said recess by screws diagonally inserted therethrough so as to pierce the inner corners of the recess.

5. A wall construction according to claim 1, wherein the legs have outer edges and the plaster board is mounted on the parallel legs so that the board edges are aligned with outer edges of the legs.

6. A wall construction according to claim 1, wherein the bight is generally flat.

7. A wall construction according to claim 6, wherein the bight has outer edges and the recess is situate somewhat inside of the outer edges of the bight.

8. A method of constructing a plaster board wall, comprising mounting a stud comprising a U-shaped channel member having parallel legs interconnected by a bight having an outer surface and having a shallow recess in the outer surface of the bight spaced from the legs for receiving a wood blocking, and securing the plaster board externally to the legs with penetrating long fasteners in areas beyond the shallow recess.

9. A method according to claim 8, wherein the legs have outer edges, and securing plaster board to the legs so that the board edges are even with the outer edges of the legs.

10. A method according to claim 9, and placing a wood blocking in the recess.

11. A method according to claim 10, and securing the wood blocking in the recess.

12. A method according to claim 11, wherein the recess is rectangular in cross-section and has inner edges, and the wood blocking is secured in place by inserting diagonally screws therethrough and into the inner edges of the recess.

13. A method according to claim 12, and securing a door jamb to the wood blocking.

* * * * *